US006612287B2

(12) United States Patent
Pursifull

(10) Patent No.: US 6,612,287 B2
(45) Date of Patent: Sep. 2, 2003

(54) ELECTRONIC THROTTLE POSITION FEEDFORWARD SYSTEM

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/978,408

(22) Filed: Oct. 16, 2001

(65) Prior Publication Data

US 2003/0070655 A1 Apr. 17, 2003

(51) Int. Cl.[7] ..... F02D 1/00
(52) U.S. Cl. ..... 123/396; 123/399
(58) Field of Search ..... 123/396, 399, 123/361

(56) References Cited

U.S. PATENT DOCUMENTS 5,809,966 A 9/1998 Streib
6,062,198 A * 5/2000 Loehr ..... 123/399
6,199,536 B1 * 3/2001 Flinspach et al. ..... 123/399

* cited by examiner

*Primary Examiner*—John Kwon
(74) *Attorney, Agent, or Firm*—John E. Kajander

(57) ABSTRACT

A method for controlling a positioning device of an internal combustion engine includes the steps of: providing an electric motor for actuating the positioning device with the positioning device applying a torque to the motor which changes sign over the positioning range; generating a drive signal for the motor in the context of a position control based upon a commanded position, whereby the drive signal controls the current through the motor; and, changing the drive signal to abruptly change the motor voltage when the position command is in the region of the torque reversal.

10 Claims, 1 Drawing Sheet

ELECTRONIC THROTTLE POSITION FEEDFORWARD SYSTEM

TECHNICAL FIELD

The present invention relates generally to control systems for internal combustion engines, and more particularly, to an electronic throttle position feedforward system.

BACKGROUND ART

Many previously known motor vehicle throttle controls have a direct physical linkage between an accelerator pedal and the throttle so that the throttle plate is pulled open by the accelerator cable as the driver presses the pedal. The direct mechanical linkage includes a biasing force that defaults the linkage to a reduced operating position, also known as idle, in a manner consistent with regulations. Nevertheless, such mechanisms are often simple and unable to adapt fuel efficiency or minimizing regulated emissions or enhancing driveability to changing traveling conditions, and add significant weight and components to the motor vehicle.

An alternative control for improving throttle control and the precise introduction of fuel air mixtures into the engine cylinders is provided by electronic throttle controls. The electronic throttle control includes a throttle control unit that positions the throttle plate by an actuator controlled by a microprocessor based on sensor input. The processors are often included as part of a powertrain electronic control that can adjust the fuel and air intake and ignition in response to changing conditions of vehicle operation as well as operator control. Protection may be provided so that an electronic system does not misread or misdirect the control and so that unintended operation is avoided when portions of the electronic control suffer a failure.

The throttle control unit that positions the throttle plate must accelerate and decelerate a mass with torque such that a given position is attained. U.S. Pat. No. 4,947,815 discloses a positioning device for a throttle flap of an internal combustion engine wherein the positioning element is electrically adjusted via a positioning motor on the basis of the driver command derived from a pedal actuation of the driver and other inputs. When the position control is acting against a known biasing torque of force, that force may be compensated for with a feedforward term. In this way, the integral control does less work and positioning performance is improved. U.S. Pat. No. 5,809,966 applies this concept to a controller for a motorized throttle. The invention described in the '966 patent bases its feedforward term on actual position. Unfortunately, this results in sub-optimal performance.

The disadvantages associated with these conventional throttle plate positioning techniques have made it apparent that a new technique using a feedforward term for throttle plate positioning is needed. The new technique should provide unproved performance over a feedforward system based on a driver-commanded throttle plate position. The present invention is directed to these ends.

SUMMARY OF THE INVENTION

It is, therefore, an object of the invention to provide an improved and reliable electronic throttle position feedforward system. Another object of the invention is to improve performance over a feedforward system based on actual throttle plate position.

In accordance with the objects of this invention, an electronic throttle position feedforward system is provided.

In one embodiment of the invention, a method for controlling a positioning device of an internal combustion engine includes the steps of: providing an electric motor for actuating the throttle by applying a torque to the motor which changes sign over the positioning range; generating a drive signal for the motor in the context of a position control based upon a commanded position, whereby the drive signal controls the voltage applied to the motor and thus the current through the motor; and, changing the drive signal to abruptly change the applied motor voltage when commanded position is in the region of the torque reversal.

The present invention thus achieves an improved electronic throttle position feedforward system. The present invention is advantageous in that the performance is improved over a feedforward system based on actual throttle plate position by basing throttle plate position on commanded position.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
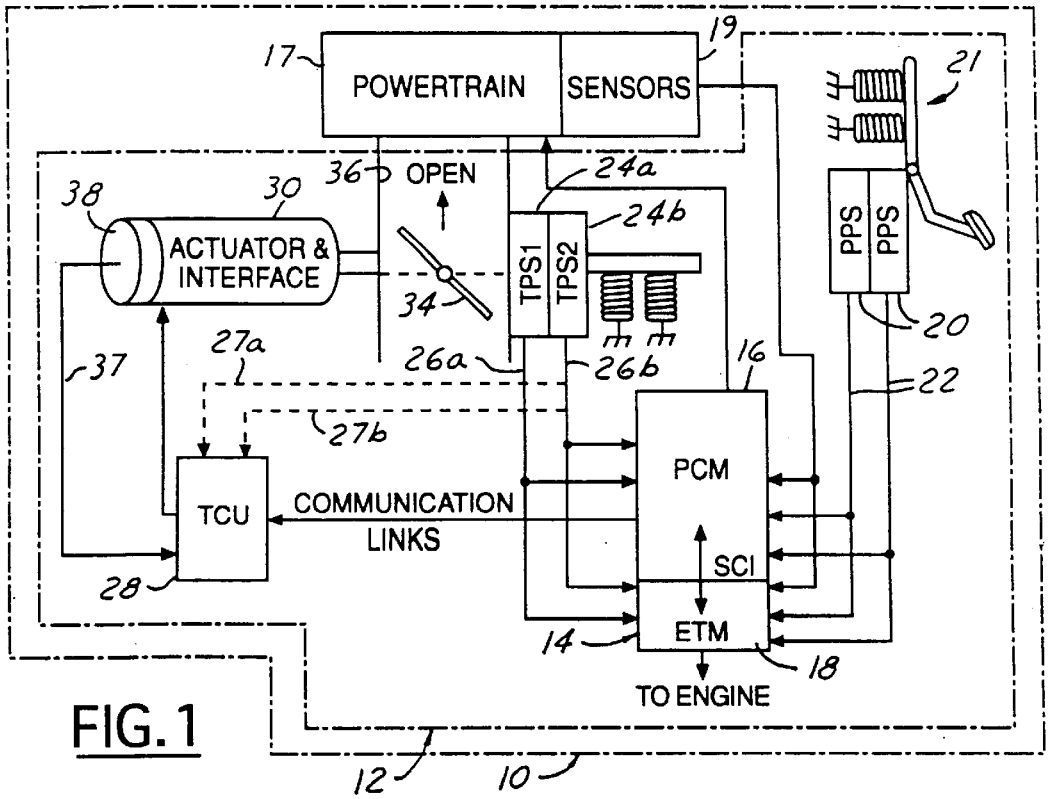
FIG. 1 is an electronic throttle position feedforward system in accordance with one embodiment of the present invention.

In the following figures, the same reference numerals will be used to identify identical components in the various views. The present invention is illustrated with respect to an electronic throttle position feedforward system, particularly suited for the automotive field. However, the present invention is applicable to various other uses that may require electronic throttle position feedforward systems.

Referring to FIG. 1, a motor vehicle powertrain system 10 including electronic throttle control system 12 includes an electronic control unit 14. In the preferred embodiment, the electronic control unit 14 includes a powertrain control module (PCM) 16 including a main processor and an electronic throttle monitor (ETM) 18 including an independent processor. The PCM and ETM share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19 and actuators 21 and 34, respectively, for independent processing.

A wide variety of inputs are represented in the FIG. 1 diagram by the diagrammatic representation of redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain a power output indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of inputs to a throttle control unit 28 that in turn powers an actuator and motive interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the throttle control unit 28, as shown at 37, 27*a* and 27*b*, respectively, to determine whether alternative responses are required or to maintain information for service or repair.

The throttle control unit that positions the throttle plate must accelerate and decelerate a mass with torque such that a given position is attained. When the position control is acting against a known biasing torque of force, that force may be compensated for with a feedforward term. In this way, the integral control does less work and positioning performance is improved. While prior art applies this concept to a controller for a motorized throttle by using a feedforward term based on actual position, also known as position feedback, the present invention uses a feedforward term based on commanded position.

In the preferred embodiment, the measuring element 20 detects the degree of actuation of the operator-controlled element 21 (accelerator pedal). This is supplied to the TCU 28. Furthermore, operating variables from measuring devices, such as engine temperature, engine speed, transmission posit on, exhaust-gas compositions air mass, flow rate, et cetera, are supplied to the TCU 28. The TCU 28 forms a desired set value for the positioning device 30 on the basis of predetermined characteristic lines, characteristic fields, tables or in the context of torque control loop or a power control loop, torque control, or power control, or speed control, or acceleration control, or simply following the pedal position. The TCU uses the commanded position of the positioning device 36. The commanded position is detected by the measuring element mentioned above.

Figure 2:
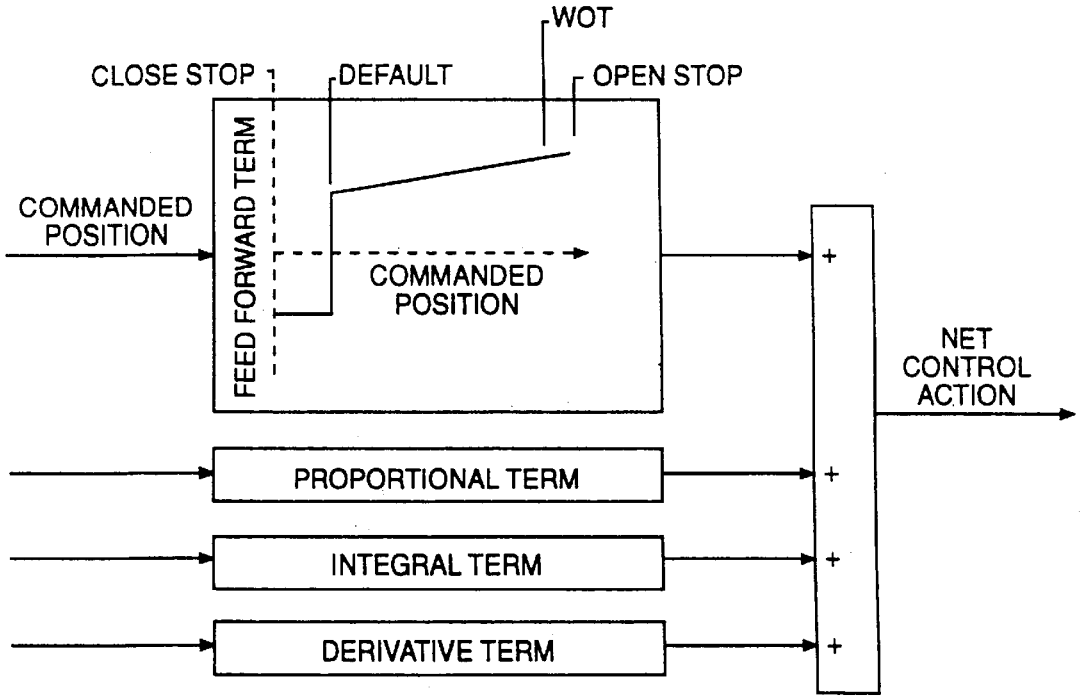
FIG. 2 is a throttle control unit of the electronic feedforward system shown in FIG. 1.

Referring now to FIG. 2, the TCU 28 then forms a drive signal on the basis of the commanded position in accordance with the pregiven strategy. The TCU 28 includes at least one integrating component 40, and, in a preferred embodiment, further includes a proportional component 42 and a differential component 44. The TCU 28 forms its drive signal 48 in a sense of an adjustment of the positioning device 30 to the pregiven desired value. The drive signal 48 is, in a preferred embodiment, a pulsewidth-modulated signal having changing pulse-duty factor which represents voltage applied to the electric motor 30 and eventually drive torque of the positioning device. In other advantageous embodiments, the drive signal 48 quantity can be a current value, a voltage value, a pulse length or the time interval between two pulses.

For movements of the positioning device 30, the position is continuously controlled to improve the control performance in the region of the so-called torque reversal point 46 at the rest position of the positioning device 30. If the positioning device's command moves beyond the torque reversal point 46, then the drive torque of the positioning motor or the motor current is changed in a quasi jump-like manner, the applied voltage is changed abruptly, then the motor current and torque follow together.

In the preferred embodiment, the motor voltage change is generated in that the integral component 40 of the controller is changed by a defined pregiven amount or in that the pulse-duty factor, with which the output stage is driven, is changed in a jump-like manner. This amount is impressed once upon the integral component 40 or on the drive signal quantity when there is a pass-through through the rest position and this amount is then not continuously maintained. If the desired set value for the positioning device 30 is very close to the torque-reversal point 46, an unstable condition can occur because of the solution provided by the invention because of a continuous current change. This is effectively avoided in that the compensation according to the invention is only then applied when the desired set value does not lie in the direct vicinity of the torque-reversal point 46. The torque-reversal point 46 (rest position) exhibits certain tolerances from one adjusting element to the other. For this reason, and to increase precision, the electronic control apparatus learns the position of the positioning device 30 when the positioning device is at a zero current (also known as default).

The present invention thus achieves an improved and reliable electronic throttle position feedforward system by basing throttle plate position on commanded position instead of actual position.

From the foregoing, it can be seen that there has been brought to the art a new and improved electronic throttle position feedforward system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A method for controlling a positioning device of an internal combustion engine, the method comprising the steps of:

providing an electronic motor for actuating said positioning device with a torque being applied to said motor over the positioning range and said torque changing sign thereby defining a torque reversal point;

detecting a commanded position of said positioning device;

determining whether said positioning device's command is in the region of said torque reversal point;

forming a drive signal for the motor on the basis of said commanded position for said positioning device; and changing said drive signal to abruptly change the motor voltage when said commanded position is in said region of said torque reversal point.

2. The method as recited in claim 1, wherein the change in said current is so adjusted that the jump in said torque, which occurs at the torque reversal point, is approximately compensated.

3. The method as recited in claim 2, wherein the abrupt change in said current is obtained by an abrupt change of the magnitude of said drive signal.

4. The method as recited in claim 3, wherein said magnitude of said drive signal is computed by a position controller of a position control; and, a pregiven value is impressed upon said magnitude.

5. The method as recited in claim 4, wherein said value is dependent upon an operating variable.

6. The method as recited in claim 4, wherein said position controller includes at least one integral component which is operated upon to generate the abrupt change of said current.

7. The method as recited in claim 6, wherein a pregiven value is impressed upon said integral component.

8. The method as recited in claim 7, wherein said value is dependent upon an operating variable.

9. The method as recited in claim 4, wherein said abrupt change does not occur when said positioning device is in a pregiven region about said torque reversal point and when a desired set value of said position control is likewise in a pregiven region about said torque reversal point.

10. The method as recited in claim 9, wherein the position assigned to said torque reversal point is detected at zero current through said motor and is stored.

* * * * *